US007221736B2

(12) United States Patent
Heidrich et al.

(10) Patent No.: US 7,221,736 B2
(45) Date of Patent: May 22, 2007

(54) EXPANSION DEVICE FOR FLUID COOLANT/INSULATION IN A X-RAY APPARATUS

(75) Inventors: Günter Heidrich, Gerhardshofen (DE); Wolfgang Kutschera, Aurachtal (DE); Matthias Seufert, Pettstadt (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/298,031

(22) Filed: Dec. 8, 2005

(65) Prior Publication Data

US 2006/0171505 A1 Aug. 3, 2006

(30) Foreign Application Priority Data

Dec. 8, 2004 (DE) ..... 10 2004 059 134

(51) Int. Cl.
*H01J 35/10* (2006.01)
*H01J 35/12* (2006.01)
*F28D 15/00* (2006.01)

(52) U.S. Cl. ..... 378/141; 378/199; 378/200; 165/104.32

(58) Field of Classification Search ..... 378/127, 378/128, 130, 141, 199–202; 165/104.32
See application file for complete search history.

(56) References Cited

U.S. PATENT DOCUMENTS 1,826,418 A * 10/1931 Bragg et al. ..... 188/357
1,968,051 A * 7/1934 Morrison ..... 378/202
2,019,602 A * 11/1935 Findlay ..... 378/202
2,272,359 A * 2/1942 Swift ..... 60/586
2,444,181 A * 6/1948 Baldwin ..... 60/588
2,457,961 A * 1/1949 Wehmer ..... 378/200
2,657,628 A * 11/1953 Von Stoeser ..... 99/323.2
6,019,026 A * 2/2000 Williams et al. ..... 92/62
6,074,092 A * 6/2000 Andrews ..... 378/200
6,237,617 B1 * 5/2001 Sturman et al. ..... 137/1
6,563,908 B1 5/2003 Enck, Jr.
2002/0118794 A1 8/2002 McCarthy, Jr.
2003/0047398 A1 * 3/2003 Toiyama ..... 188/314
2006/0067478 A1 * 3/2006 Canfield ..... 378/141

FOREIGN PATENT DOCUMENTS

WO WO 02/08295 10/2002

* cited by examiner

*Primary Examiner*—Edward J. Glick
*Assistant Examiner*—Anastasia S. Midkiff
(74) *Attorney, Agent, or Firm*—Schiff Hardin LLP

(57) ABSTRACT

In an expansion device for an x-ray apparatus, in particular with a rotary piston x-ray tube with a sealed coolant and/or insulation volume under a minimum pressure and pressing with this minimum pressure against an elastic pressure element, an elastic pressure element with a linear force-displacement characteristic curve (in particular in the form of a gas pressure spring with a linear elastic characteristic curve) is provided to prevent an excessive pressure load given a temperature rise.

17 Claims, 3 Drawing Sheets

EXPANSION DEVICE FOR FLUID COOLANT/INSULATION IN A X-RAY APPARATUS

BACKGROUND OF THE INVENTION

1. Field of the Invention

The present invention concerns an expansion device for the coolant/insulating fluid in an x-ray apparatus as well as an x-ray radiator with such an expansion device.

2. Description of the Prior Art

In a medical x-ray apparatus, to reduce the heat that accumulates due to the generation of x-ray radiation it is necessary to provide cooling for the x-ray tube arranged in an x-ray radiator. For cooling it is known to surround the x-ray tube with a coolant which can (as, for example, insulating oil) exhibit insulation properties. The coolant and/or insulation must exhibit a pressure that is high enough to prevent an outgassing, since otherwise the cooling capacity and/or the ability to withstand electrical voltages are reduced, but is low enough to prevent damaging of the x-ray tube due to overpressure.

For this purpose, expansion devices are known that ensure a defined minimum pressure for the coolant and/or insulation means and allow an expansion (caused by a temperature increase) of the coolant and/or insulation within a defined range. Particularly in the case of x-ray apparatuses with rotary piston x-ray tubes rotating in coolant and/or insulation, negative pressure can be created due to the rotation movement. Such known expansion devices are formed by a reservoir in which the coolant and/or insulation means is located and a sealed air chamber (such as, for example, an airbag or a metal bellows) is provided to ensure the minimum pressure. An expansion of the coolant and/or insulation compresses the sealed air chamber, leading to an excessive, exponential increase of the pressure. If the pressure rises too high, the x-ray apparatus is deactivated (triggered by a pressure switch).

SUMMARY OF THE INVENTION

An object of the present invention is to provide a simple expansion device for an x-ray apparatus that ensures a defined minimum pressure of the coolant and/or insulation and that also prevents an excessive pressure load of the x-ray apparatus given a temperature rise.

The above object is achieved by an expansion device for an x-ray apparatus with a coolant and/or insulation having an elastic pressure element with an essentially linear force-displacement characteristic curve that still ensures a minimum pressure while allowing a linear pressure rise in a simple manner dependent on a rising temperature of the coolant and/or insulation. Given an elevated temperature, an excessive final pressure (as with an exponential pressure rise) is prevented and thus the components of the x-ray apparatus, in particular the x-ray tube in the coolant and/or insulation, are less pressure-loaded and thus can be designed overall for a lower pressure and so can be produced with less expenditure.

The term "curve" is used herein in the mathematical sense of describing a graphed relationship between two parameters, and thus encompasses a relationship that is entirely or substantially linear.

In a manner advantageous for a simple realization of the expansion device, an arrangement of the cooling and/or insulation volume is provided in an expansion reservoir so that the expanded volume presses against the elastic pressure element given an expansion of the cooling and/or insulation means volume due to the temperature rise.

In an embodiment of the invention advantageous for by low-cost production, sealing of the expansion reservoir is provided by a piston that can be shifted due to the volume increase and thus can be pressed against the elastic pressure element. In an advantageous manner, the expansion device has a piston that can be displaced along the inner wall of the expansion reservoir. At one axial (in the displacement direction) side of the piston, the coolant and insulation is enclosed by the expansion reservoir and at other axial side the expansion reservoir has an air chamber open to the outside and thus free of counter-pressure.

A further embodiment of the expansion device that can be produced in a simple and particularly compact manner seals the expansion reservoir with a bellows (in particular a metal bellows) that is compressed due to the expansion of the coolant and/or insulation and is thereby pressed against the elastic pressure element. The bellows can be arranged so as to be compressed within the expansion reservoir. On the outside of the bellows the coolant and/or insulation is enclosed by the expansion reservoir and on the inside of the bellows an air chamber is enclosed that is open to the outside.

In a further embodiment of the expansion device seals the expansion reservoir with a bellows (in particular a metal bellows) that is expanded due to the expansion of the coolant and/or insulation and thereby is pressed against the elastic pressure element. The bellows can expand within the expansion reservoir. On the inside of the bellows the coolant and/or insulation is enclosed and on the outside of the bellows the expansion reservoir encloses an air chamber open to the outside.

In a further embodiment of the invention, the expansion device has an elastic pressure element is given the elastic element with an essentially linear elastic characteristic curve by means of a biasing element. To accommodate a slow rise of the pressure, the biasing element gives the elastic pressure element a characteristic curve having a slope between 8% and 45%. According to a further embodiment of the invention, the biasing element is in the form of a gas pressure spring with an essentially linear force-displacement characteristic curve.

Although the invention can be used to advantage in an x-ray radiator with an x-ray tube in a coolant and/or insulation, the invention is not limited to, this type of apparatus.

DESCRIPTION OF THE PREFERRED EMBODIMENTS

Figure 1:
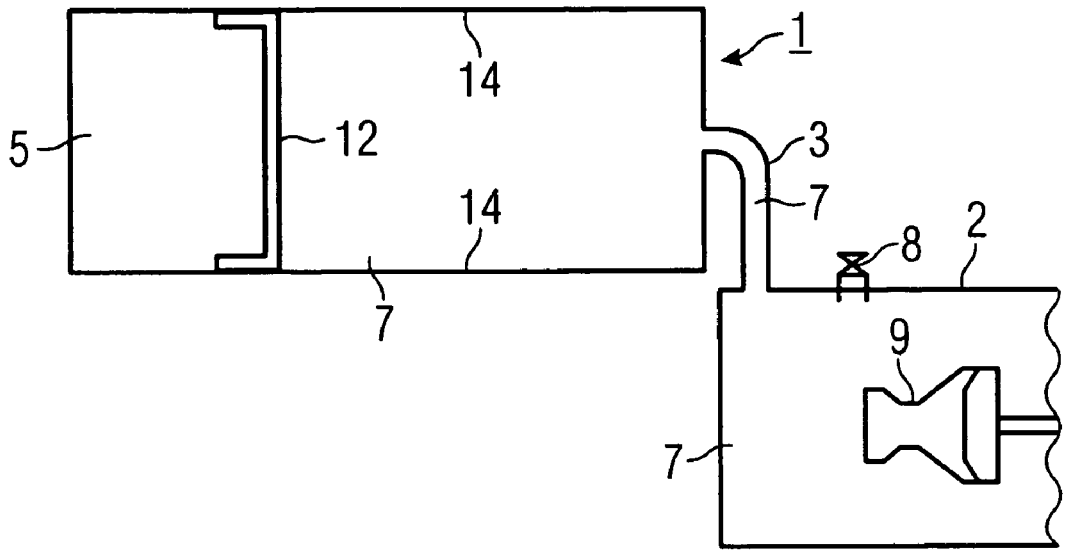
FIG 1 (PRIOR ART)
FIG. 1 shows a known expansion device for an x-ray apparatus with an expansion reservoir for a closed coolant and insulation volume that presses on a closed air compression chamber given a temperature rise.

FIG. 1 shows a known expansion reservoir 1 that is connected at its right end with an x-ray radiator 2 via an oil feed 3, and has a closed air chamber 5 at its left end and a,piston 12 that can be displaced along its inner wall 14. A coolant and/or insulation in the form of oil 7 is enclosed between the piston and the right end of the expansion reservoir such that the closed air chamber 5 presses against said oil 7 with a minimum pressure given a normal, non-elevated temperature. A rotary piston x-ray tube 9 to be cooled is supported in the x-ray radiator 2 filled with oil 7 such that it can rotate. Given a temperature rise, the oil volume in the right end of the expansion reservoir 1 increases and thereby presses harder on the piston 12, such that the piston 12 is displaced and the counter-pressure in the closed air chamber (and therewith also the pressure in the oil 7) exponentially increases.

A safety pressure switch 8 deactivates the x-ray apparatus given excessive pressure, meaning pressure endangering the rotary piston x-ray tube 9 of the x-ray radiator 2. This can lead to unwanted interruptions of examinations involving the x-ray apparatus.

Figure 2:
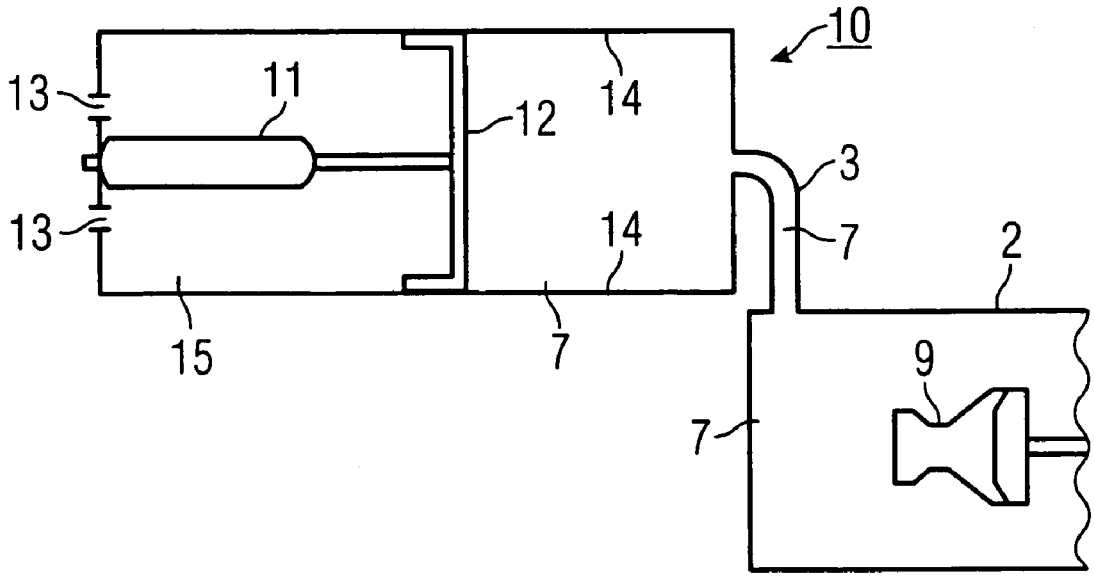
FIG. 2 shows an inventive expansion device for an x-ray apparatus with an expansion reservoir for a closed coolant and insulation volume that presses on a gas pressure spring with a linear elastic characteristic curve via a displaceable piston given a temperature rise.

FIG. 2 shows an inventive expansion device that differs from the prior art in that an expansion reservoir 10 has an air chamber 15 open to the outside instead of a closed air chamber, such that the formation of an excessive pressure is prevented given a temperature rise. The piston 12 is displaced along the inner wall 14 of the expansion reservoir 10 corresponding to the essentially linear force-displacement characteristic curve of a pressure element, in particular of a gas pressure spring 11. According to one embodiment of the invention, an arrangement of the elastic pressure element (in particular of the gas pressure element 11) in the air chamber 15 open to the outside is provided in the expansion reservoir 10. The linear elastic characteristic curve (i.e. the linear relationship between pressure and displacement), of the gas pressure spring preferably has a slope between 8% and 45%, particularly preferably between 8% and 15%. Due to the linear elastic characteristic curve of the inventive gas pressure spring and because air escape to the environment via the opening 13 is possible given the opened air chamber 15 (and the air is not likewise compressed, as in the prior art), the pressure of the oil 7 merely rises linearly. Endangerment of the components of the x-ray radiator 2 due to an exponential pressure increase given just a relatively slight temperature rise can thus is precluded.

Figure 3:
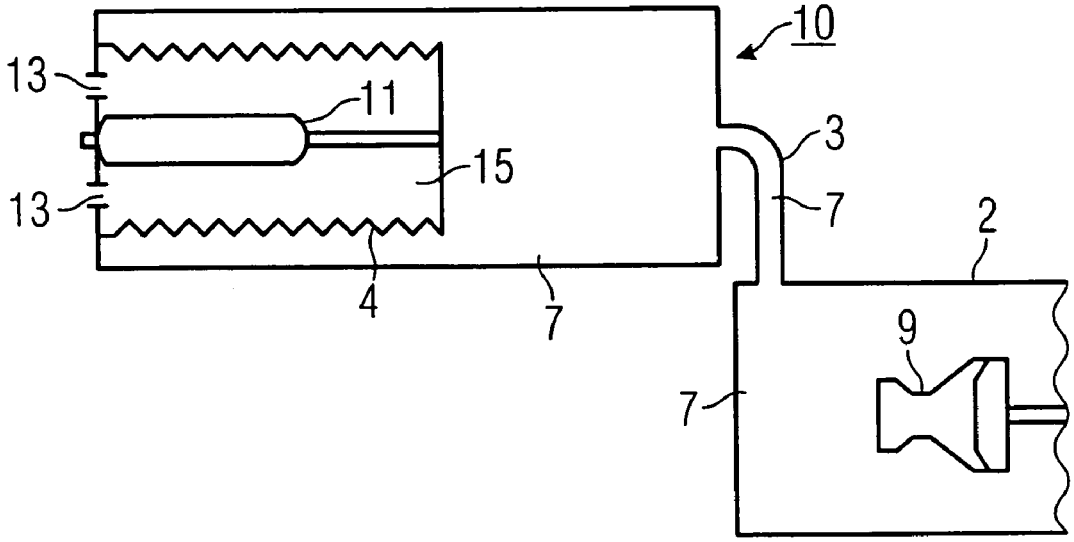
FIG. 3 shows an inventive expansion device for an x-ray apparatus with an expansion reservoir for a closed coolant and insulation volume that presses on a gas pressure spring with a linear elastic characteristic curve via a bellows given a temperature rise.

FIG. 3 shows a further embodiment of the inventive expansion device in which the expansion reservoir 10 has a metal bellows 4 (in which the gas pressure spring 11 with a linear elastic characteristic curve is disposed) instead of a piston. If an expansion of the oil 7 occurs due to a temperature rise, the gas pressure spring 11 located in the metal bellows 7 is compressed corresponding to its elastic constant. The metal bellows 14 is likewise compressed and emits air into the environment through the openings 13; the pressure in the expansion reservoir 10 likewise rises linearly.

Figure 4:
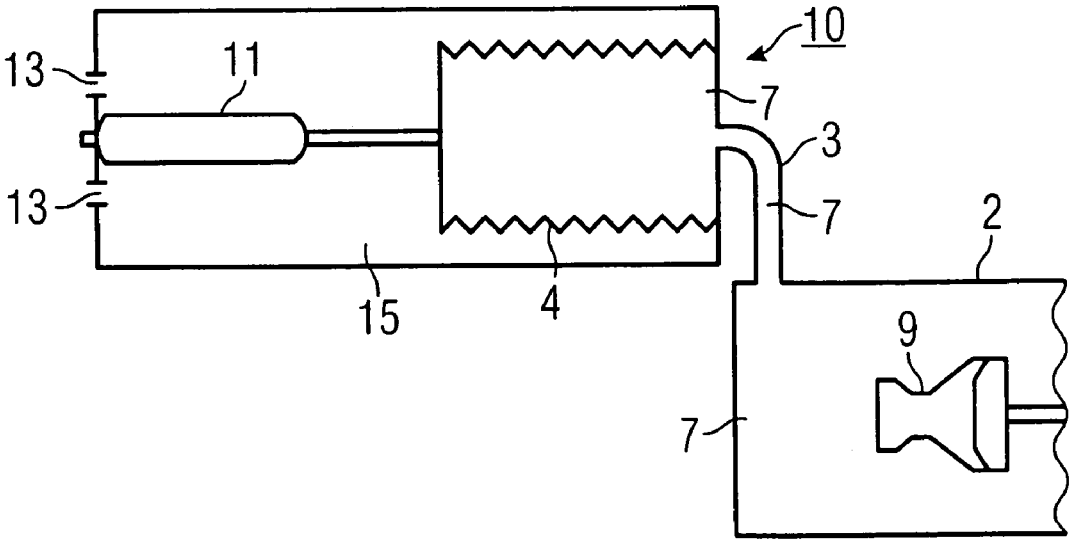
FIG. 4 shows an inventive expansion device for an x-ray apparatus with an expansion reservoir or a closed coolant and insulation volume that is located in a bellows and presses on a gas pressure spring with a linear characteristic curve given a temperature rise.

FIG. 4 shows a further embodiment of the inventive expansion device in which, in contrast to FIG. 3, the oil 7 is arranged inside the metal bellows 4. The opened air chamber 15 is located outside of the metal bellows 4 in the expansion reservoir. If an expansion of the oil 7 occurs due to a temperature increase, the metal bellows 4 expands and compresses the gas pressure spring 11 corresponding to its elastic constant; here the pressure in the oil 7 also rises linearly.

Figure 5:
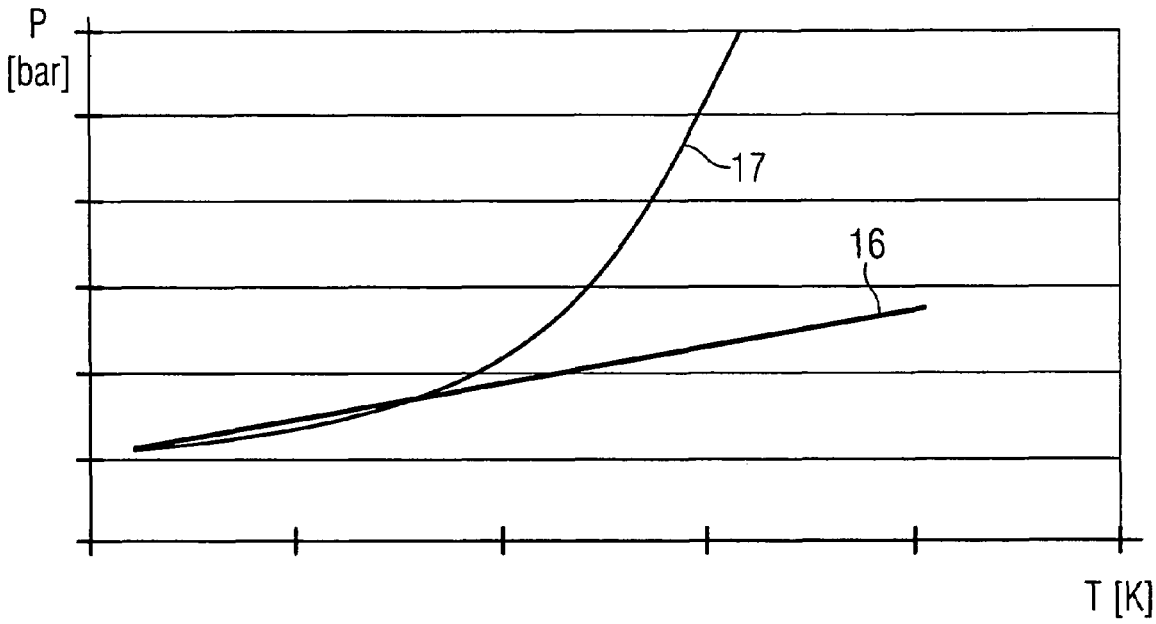
FIG. 5 shows a temperature-pressure diagram with a known exponential characteristic curve and with a linear characteristic curve that is achieved with the inventive expansion device.

FIG. 5 shows a temperature-pressure diagram that contrasts the exponential pressure rise 17 in the oil, of a typical expansion device with a closed air chamber according to the prior art with the linear pressure rise 16 of an inventive expansion device with an opened air chamber 15 and a gas pressure spring 11 with an elastic characteristic curve rise of approximately 15%. A pressure that could endanger the x-ray tube is only achieved (if at all) by the inventive expansion device at a clearly higher temperature than in a system according to the prior art.

The invention can be briefly summarized as follows. In an expansion device for an x-ray apparatus, in particular with a rotary piston x-ray tube with a sealed coolant and/or insulation volume under a minimum pressure and pressing with this minimum pressure against an elastic pressure element, an elastic pressure element with a linear force-displacement characteristic curve (in particular in the form of a gas pressure spring 11 with a linear elastic characteristic curve) is provided to prevent an excessive pressure load given a temperature rise.

Although modifications and changes may be suggested by those skilled in the art, it is the intention of the inventors to embody within the patent warranted hereon all changes and modifications as reasonably and properly come within the scope of their contribution to the art.

We claim as our invention:

1. An expansion device for an x-ray apparatus, said x-ray apparatus containing a sealed volume of fluid, at a minimum pressure, for cooling or insulation, said expansion device comprising:

an elastic pressure element in contact with and pressing against said sealed volume of fluid with said minimum pressure, said elastic pressure element having a substantially linear force-displacement characteristic curve and being displaced according to said substantially linear force-displacement characteristic curve, having a constant slope in a range between 8% and 45%, as said volume of fluid increases and produces a pressure above said minimum pressure due to an increase in temperature of said volume of fluid.

2. An expansion device as claimed in claim 1, comprising an expansion reservoir in which at least a portion of said volume of fluid is disposed, said elastic pressure element being in communication with said expansion reservoir.

3. An expansion device as claimed in claim 2, wherein said elastic pressure element comprises a piston in said expansion reservoir that is displaced in said expansion reservoir, according to said substantially linear force-displacement characteristic curve, when said volume of fluid increases due to said increase in temperature.

4. An expansion device as claimed in claim 3, wherein said expansion reservoir has an interior wall against which said piston slides when said piston is displaced, and wherein said piston has a first side facing said portion of said volume of fluid in said reservoir, and a second side facing a volume of air, said volume of air communicating with an exterior of said expansion reservoir.

5. An expansion device as claimed in claim 4, comprising a biasing element acting on said second side of said piston with said substantially linear force-displacement characteristic curve.

6. An expansion device as claimed in claim 5, wherein said biasing element is a gas pressure spring having said substantially linear force-displacement characteristic curve.

7. An expansion device as claimed in claim 2, wherein said elastic pressure element comprises a compressible bellows disposed in said expansion reservoir that is compressed by said increase of said volume of said volume of fluid due to said increase in temperature.

8. An expansion device as claimed in claim 7, wherein said bellows has an exterior and an interior, and wherein said exterior of said bellows is in contact with said portion of said volume of fluid in said expansion reservoir, and wherein said interior of said bellows encloses an air volume that communicates with an exterior of said expansion reservoir.

9. An expansion device as claimed in claim 8, comprising a biasing element acting on said interior of said bellows with said substantially linear force-displacement characteristic curve.

10. An expansion device as claimed in claim 9, wherein said biasing element is a gas pressure spring having said substantially linear force-displacement characteristic curve.

11. An expansion device as claimed in claim 2, wherein said elastic pressure element comprises an expandable bellows disposed in said expansion reservoir, that is expandable by said increase of said volume of said volume of fluid due to said increase in temperature.

12. An expansion device as claimed in claim 11, wherein said bellows has an interior and an exterior, said portion of said volume of fluid being disposed in said interior of said bellows, and said exterior of said bellows being in contact with a volume of air in said expansion reservoir that communicates with an exterior of said expansion reservoir.

13. An expansion device as claimed in claim 12, comprising a biasing element acting on said exterior of said bellows with said substantially linear force-displacement characteristic curve.

14. An expansion device as claimed in claim 13, wherein said biasing element is a gas pressure spring having said substantially linear force-displacement characteristic curve.

15. An x-ray radiator comprising:

a radiator housing;

an x-ray tube disposed in said radiator housing;

a sealed volume of fluid, at a minimum pressure, surrounding said x-ray tube in said radiator housing for cooling or insulating said x-ray tube; and an expansion device comprising an elastic pressure element in contact with and pressing against said sealed volume of fluid with said minimum pressure, said elastic pressure element having a substantially linear force-displacement characteristic curve, having a constant slope in a range between 8% and 45%, and being displaced according to said substantially linear force-displacement characteristic curve as said volume of fluid increases and produces a pressure above said minimum pressure due to an increase in temperature of said volume of fluid.

16. An expansion device as claimed in claim 1 comprising a gas pressure spring acting on said piston as a biasing element to produce said substantially linear force-displacement characteristic curve.

17. An x-ray radiator as claimed in claim 15 comprising a gas pressure spring acting on said piston as a biasing element to produce said substantially linear force-displacement characteristic curve.

* * * * *